United States Patent [19]

Dilo

[11] 4,124,731

[45] Nov. 7, 1978

[54] NEEDLED NON-WOVEN TUBING

[75] Inventor: Richard Dilo, Eberbach-N, Fed. Rep. of Germany

[73] Assignee: Rontex America Inc., Chelmsford, Mass.

[21] Appl. No.: 835,330

[22] Filed: Sep. 21, 1977

Related U.S. Application Data

[60] Division of Ser. No. 681,089, Apr. 19, 1976, Pat. No. 4,085,486, and a continuation-in-part of Ser. No. 386,552, Aug. 8, 1973, Pat. No. 3,952,121, which is a division of Ser. No. 116,030, Feb. 17, 1971, Pat. No. 3,758,926, which is a continuation-in-part of Ser. No. 882,391, Dec. 1, 1969, abandoned, which is a division of Ser. No. 741,492, Jul. 1, 1968, Pat. No. 3,530,557.

[30] Foreign Application Priority Data

Nov. 21, 1975 [DE] Fed. Rep. of Germany ..... 2552243

[51] Int. Cl.[2] ..... B32B 1/08

[52] U.S. Cl. ..... 428/36; 428/284; 428/300

[58] Field of Search ..... 428/36, 113, 284, 300; 28/110

[56] References Cited

U.S. PATENT DOCUMENTS

| | | | |
|---|---|---|---|
| 3,508,307 | 4/1970 | Dilo | 28/110 |
| 3,540,096 | 11/1970 | Porta | 28/110 |
| 3,909,893 | 10/1975 | Wilde | 28/110 |
| 3,952,121 | 4/1976 | Dilo | 428/36 |

*Primary Examiner*—James J. Bell
*Attorney, Agent, or Firm*—Sherman & Shalloway

[57] ABSTRACT

Non-woven tubing is formed by winding a web on a stationary mandrel, multi-needling overlying turns and frictionally driving the formed tube about the periphery of the mandrel. The mandrel is tapered to accommodate shrinkage of the tube and to assist ejection of the formed tube without application of longitudinal tension on the formed tube. The mandrel preferably includes a helical surface for progressively ejecting the rotating tubing from the static mandrel. The tube product may be formed with diameters as low as 4 millimeters and walls as thin as 0.5 and is radially compressed immediately after needling.

1 Claim, 3 Drawing Figures

NEEDLED NON-WOVEN TUBING

DATA RE RELATED APPLICATIONS

This is a division of application Ser. No. 681,089, filed Apr. 19, 1976, now U.S. Pat. No. 4,085,486, and a continuation-in-part of my copending application Ser. No. 386,552, filed Aug. 8, 1973 entitled "Felted Web and Method of Making Same," now U.S. Pat. No. 3,952,121 which is a division of my application Ser. No. 116,030, filed Feb. 17, 1971 now U.S. Pat. No. 3,758,926 which is a continuation-in-part of my application Ser. No. 882,391 filed Dec. 1, 1969, now abandoned, which in turn is a division of parent application Ser. No. 741,492 filed July 1, 1968 and now U.S. Pat. No. 3,530,557, dated Sept. 29, 1970.

BACKGROUND OF THE INVENTION

The present invention relates to the production of needled, non-woven tubings and is concerned, more particularly, with the continuous production of such tubings with lowered weight per unit wall area and, with the capability of producing such tubings of minimal diameter and reduced weight per unit of wall area of the tubing.

BRIEF DISCUSSION OF THE PRIOR ART

A variety of attempts have been made in the production of tubular textiles having structural properties suitable for industrial and surgical services such as industrial filtering or de-watering and as vascular prostheses.

Earlier attempts involved the use of woven or knitted media, either installed as a sleeve about heterogeneous structure or as a tubular extension between terminal portions of ducts or fittings. However, the permeability of the textile tube is an important, sometimes critical, factor in the sucess of the tubes in these services. Furthermore, the uniformity of the desired permeability, throughout the length and full surface area of the tube, is especially important in many such services.

Where variations in permeability are encountered there occurrs a corresponding variation in fluid flow and a consequent disruption of the uniformity of the operation.

Where the structural properties of the tube are relied upon during its service and such variations in permeability are present, there occurrs a corresponding structural weakness in the areas of excess permeability. Such weakness subsequently may cause distension or even rupture of the tube wall.

Prior attempts in improving the permeability of such tubes and control of the uniformity of the tube during its production have involved inclusions in the fabric, such as stray fibers, veloured webs, or flocking of the web and, tufting or looping of the exterior portion or faces of the web.

However, the more recent and more sucessful approaches have been predicated upon the use of non-woven, non-knitted webs of material strands, usually referred to as felted webs. These "felted" material tubes have afforded many advantages over the woven- or knitted-material sleeves.

An especially effective and advantageous tubing of needled, non-woven fabric is disclosed in my aforementioned copending application Ser. No. 386,552, filed Aug. 8, 1973, the disclosure of which is to be considered incorporated herein.

While these tubes of non-woven fabric are in demand and of distinct advantage in industrial applications as filter media, roller sleeves, and the like, the most exacting requirements to be met thereby are in the field of surgery, in which human life is directly dependent upon the several qualities of the tubing.

Therefore, it is appropriate to detail these requirements and the reasons therefor, it being apparent to those skilled in the art that the tubings exhibiting successful accomodation of these surgical requirements will provide comparable advantages in the other, industrial services.

In service as a vascular prosthesis, the precise permeability and a uniformity thereof are an absolute necessity.

The permeability requirements appear to be self-contradictory in this service, since the function of the tubular prosthesis is that of replacing diseased or damaged vascular sections and, accordingly, serving as a conduit for blood between healthy or undamaged vascular sections. In service, therefore, the tubing necessarily is to be substantially impervious to blood and its constituents.

However, in order to achieve adequate healing at the suture points and tissue generation along the prosthesis, it is necessary that the wall structure of the tubing be permeable to permit radial migration of cellular matter to enable tissue migration radially into the tubing to form a "live" vascular member encasing, and structurally supported by, the tubular prosthesis.

The preferred solution to these apparently contradictory requirements has been that of providing permeable tubing which is made initially impermeable, before installation, by a pre-clotting step which closes the interstices of the tubular wall sufficiently to make the tubing impermeable when installed. Eventually, the clotted matter is to be replaced by cellular intrusion through the tube-wall interstices, and absorption of the clotted material.

However, the presence of the pre-clotted matter makes such prosthesis potentially highly-thrombogenic. Accordingly, it is imperative that the structure of the tubing provide for secure adhesion and retention of all such clotted matter, in order to avoid release and a consequent thrombus downstream of the prosthesis.

This requirement of providing optimal surfaces for adherence of clotted matter also serves to the advantage of the subsequent progression of new tissue into and through the wall of the tubing. Accordingly, the interstitial and surface characteristics are important to the succesful service of the tubing, along with the close control of the permeability.

The desired permeability, however, necessarily is to be uniform both along the length of the tubing and about its circumference. Significant variations from such uniformity can prevent passage of desired constituents, if the permeability is below the preselected level. Where areas of excessive permeability are present, excessive rates of constituent transfer may occur and the concomitant structural differences or weakness make the tube wall prone to distension, ballooning, aneurysmal dilation or even rupture at that zone.

The non-woven tubing of my aforementioned application Ser. No. 386,552 has proven to be quite advantageous over prior tubings, and especially so in service as a vascular prosthesis, and meets the several requirements set forth hereinbefore.

However, the production of the tubing required close synchronization of the layer-winding speed and the tube take-up rate, especially since the tube take-up apparatus exerts a tension upon the tubing.

The problems encountered in the production of such tubings become even more acute when it is desired to produce relatively small tubes such as are often desired as vascular prosthesis.

Prior systems have included units for winding and needling a non-woven web on a mandrel which is longitudinally grooved to provide a trough for picks which continuously move the formed tubing parallel to the axis of the mandrel. These machines, therefore, are limited to relatively large diameter mandrels, to accomodate the withdrawing equipment, in the order of about 40 millimeters, the actual size depending upon the size of the slide rollers and the length of their pins.

A further limitation of such units involves the wall-strength of the finished tube, the minimum strength of which has required about 4 millimeters. This corresponds to a weight of from 350 to 400 grams per square meter of wall area.

A reduction of these dimensions and weights has not been possible with the use of the prior discharge mechanisms. Consequently, the prior means of withdrawal and discharge of the tubing of such installations have been costly and imposed problems in the operation and versatility of the installation.

Therefore, prior methods and installations for forming non-woven tubings have not been found to be entirely satisfactory in all respects.

OBJECTS OF THE INVENTION

It is an object of the present invention to provide an improved system for producing needled tubing of non-woven fabric.

It is another object of the present invention to provide an improved system for producing tubing of non-woven fabric which is wound in overlapping layers and needled at multiple angles.

It is a further object of the present invention to provide tubing of non-woven fabric which is wound in overlapping layers on a mandrel, needled at multiple angles, and pressed against the mandrel by an external pressing roll.

It is yet another object of the present invention to provide needled, non-woven tubing formed on a mandrel, the tubing being rotated on the mandrel by external driving rolls.

A further object of the present invention is the provision of a needled, non-woven tubing formed on a mandrel, the tubing being discharged from the mandrel by a helical surface and relative rotation between the tubing and the helical surface.

Another object of the present invention is the provision of a needled, non-woven tubing formed on a mandrel and needled at multiple angles, while being pressed against the mandrel and rotated by rotating pressure rolls, and discharged from the mandrel by its rotation against a helical surface on the mandrel.

A further object of the present invention is the provision of a needled, non-woven tubing which is formed on a mandrel, radially compressed and then discharged from the mandrel.

SUMMARY OF THE INVENTION

In general, the preferred form of the present invention comprises a tube-winding and needling station including a tapered mandrel having needle apertures in its region of larger diameter, a reciprocating bar having a plurality of needles aligned with the needle apertures, and at least one driving roll in pressing relationship with the tubing being formed. Preferably, the mandrel includes a helical surface downstream of the needle apertures and within the zone of pressure of the driving roll.

The present invention is capable of continuously producing high quality non-woven tubing in diameters down to 4 or 5 millimeters and with reduced weight per unit of wall area. This can be accomplished without the requirement of special preparation equipment, such as carding installations, with only a narrow band of thin, non-woven material being supplied directly to the winding unit. Therefore, the distortion and longitudinal orientation of the fibers which are typical of the prior art can be avoided and the desired, multiple interengagement of the fibers can be obtained, while the cost of tube-withdrawing equipment is avoided.

BRIEF DESCRIPTION OF THE DRAWINGS

A better understanding of the invention and its objects may be derived from the following description and accompanying drawings, in which.

DETAILED DESCRIPTION OF THE PREFERRED EMBODIMENT

Figure 1:
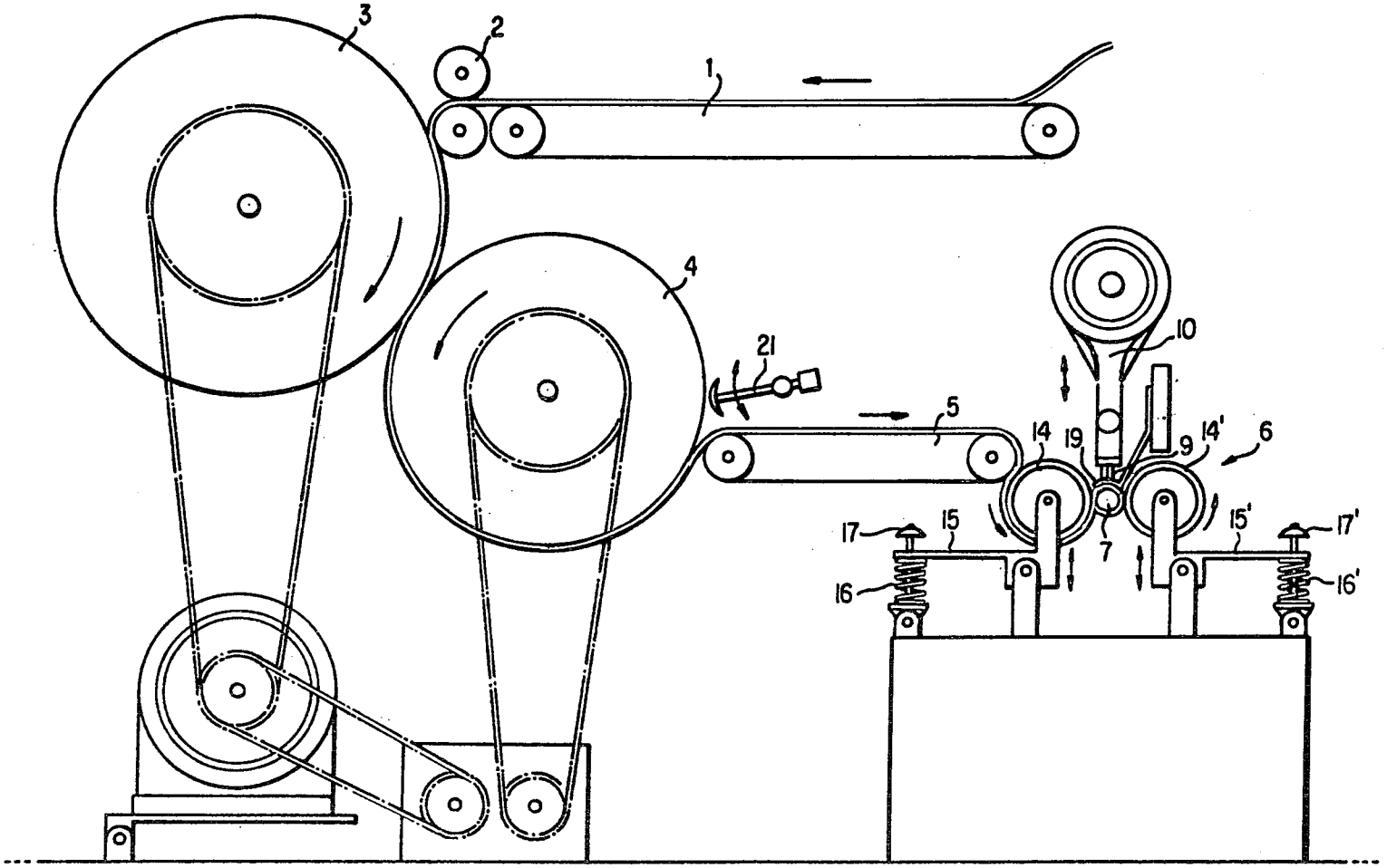
FIG. 1 is a partly-schematic side elevation of a tube-forming installation embodying the invention.
Figure 2:
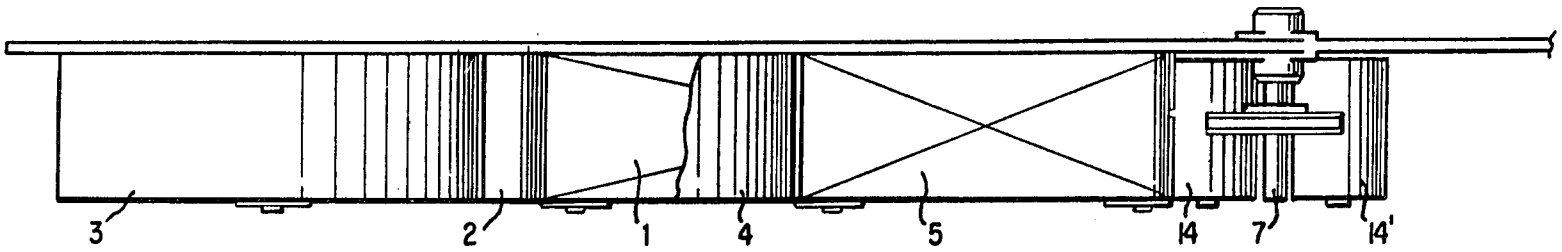
FIG. 2 is a plan view of the installation of FIG. 1.
Figure 3:
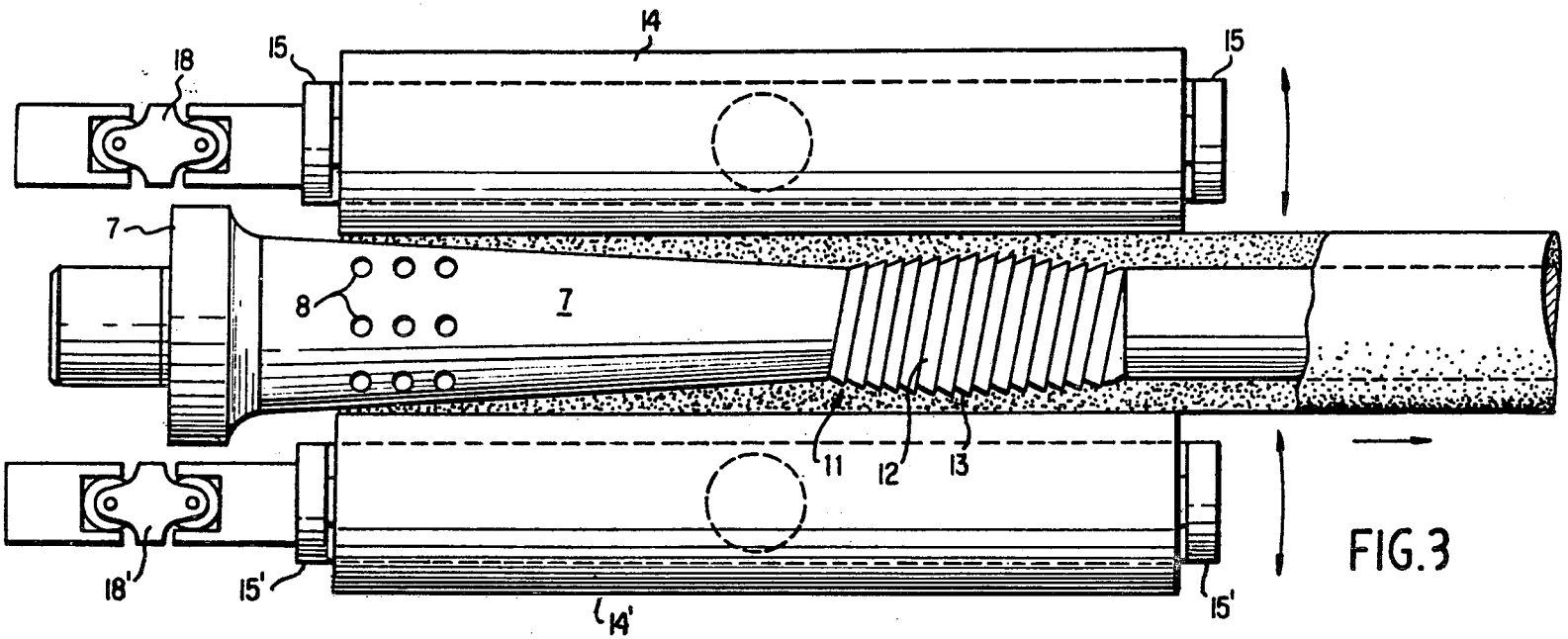
FIG. 3 is a view of a portion of FIG. 2, on an enlarged scale, with portions removed for clarity and showing details of the tube-forming unit.

As shown in the drawings, the preferred form of tube-forming apparatus according to the invention comprises an installation including a conveyor 1, a nip-roller 2, an orienting and transfer station including first and second rolls 3 and 4, respectively, and a conveyor 5 for delivering the pressed web to a needling and tube-forming machine 6.

The web received on the conveyor 1 may be a commercial web, as received, or may be subjected to a precarding step if desired. The web typically comprises fibers which are felted with their lengths oriented generally longitudinally of the web and in generally parallel relationship.

The material of the web may be textile, metal or mineral fibers or filaments, or a mixture thereof. The fibers or filaments are to be very thin and flexible.

The tube-forming unit 6 includes a stationary mandrel 7 having a plurality of needle apertures 8 for receiving reciprocating needles 9 of a needling head 10. The mandrel 7 tapers toward a discharge end remote from the needling zone and includes a helical section 11.

The helical section preferably is formed with saw-toothed flights 12 which individually taper outwardly to an apex 13 at their trailing or downstream edge. The flights progressively enlarge in diameter toward the center or an intermediate zone of the helix and again reduce in diameter toward the discharge end. The axis of the helical section is coaxial with the axis of the mandrel and the tubing.

Flanking the stationary mandrel, a pair of drive rolls 14 and 14' are mounted substantially diametrically opposite each other on hinged yokes 15, 15' which are adjustably biased by means of compression springs 16, 16' and lever arms to rock inwardly to press the rollers 14, 14' inwardly toward the mandrel.

The rollers 14, 14' preferably are parallel to the tapered mandrel surface and are covered with rubber or another material suitable for providing a driving friction against a tube in position on the mandrel. The amount of pressure with which the rollers bear against the tube may be adjusted by means of threaded hand wheels 17, 17'. The rollers are driven by suitable variable-speed drive means, not shown, via universal joints 18 and 18'.

The needling head 10 is driven by conventional means and has associated therewith a stripper or foot member 19 which is curved to conform to the material contour in the needling zone to prevent lifting of the needled material by retraction of the needles. The needles are barbed, with the wide portion of the barbs facing the penetrating point to catch fibers and to draw the fibers inwardly through underlying layers of the windings.

The needling procedure is as disclosed in my aforementioned application Ser. No. 386,552 and the tube product is therefore needled by a plurality of needles at differing angles with respect to the radius of the tubing.

The several conveyors 1 and 5 and rolls 2, 3 and 4 preferably are all driven by variable-speed drives to provide a precise rate of feed of the silver or web to the tube forming unit. In order to stabilize this critical supply factor and to initiate a desirable transverse re-orientation of the fibers, it is preferable to draw the web through the nip rolls 2 at a linear speed slightly in excess of the speed of the belt conveyor 1; deposit the web in thinned form on the surface of the roll 3 by rotating the roll at a peripheral speed considerably higher than the linear speed through the nip rolls, and collect the web in a partially-jumbled condition, with its fibers partially transversely-reoriented, on the roll 4, which is rotated at a much lower peripheral speed than the roll 3. This initial fiber reorientation is enhanced if the rolls 3 and 4 are provided with tractive surfaces, such as metallic card cloth, and a stripping comb 21 is positioned adjacent the conveyor 5 to strip the sliver or web from the roll 4.

The speed of the conveyor 5 is then matched to supply the web to the drive roll 14 at the desired rate.

OPERATION OF THE PREFERRED EMBODIMENT

In operation, a suitably-prepared, extremely thin sliver or web of material is supplied to the roll 14 and passes therearound to wind on the mandrel and subsequently is needled at multiple angles to form the non-woven tubing. Each needle penetration drives fibers from the outer layers angularly into the subjacent layers, thereby firmly securing and interlocking the windings into a continuous tubing.

The continuous tubing thus produced is driven around the stationary mandrel by the drive rolls 14 and 14' and, as a result of the presence of the helix 11 against which it is pressed, continuously ejects itself or literally screws itself off the stationary mandrel.

This self-ejecting effect is actually enhanced by the shrinkage tendency of the tubing, when it is so needled. The shrinkage, the taper of the mandrel and the enlargement of the helix thus cooperate in the ejection of the tubing, instead of the shrinkage being effective to oppose removal of the tubing, thereby requiring tensioning stresses to be imposed for withdrawal.

In direct contrast to longitudinal-stretching for withdrawal of the tubing, the tubing formed in accordance with the present invention is actually compressed radially on the helix and is, therefore, pressed off the mandrel without longitudinal distortions.

The actual taper of the mandrel will depend upon the type of fiber and its shrinkage tendency upon needling, and may be in the order of 1.5° to 2° taper.

Preferably, the helix is formed as a threadably-interchangeable component of the mandrel, so that helices of differing pitches may be employed.

Variations of the ejection rate of the tubing may be accomplished by the use of different helices and by adjustment of the speed of the drive rollers, thereby modifying the wall thickness of the tubing, for a given rate of web intake.

It should be noted that the supply of the incoming web over the surface of the drive roller 14 is especially advantageous. The resultant flattening or pressing of the web between the drive roller 14 and the mandrel 7 thus orients and de-lofts the web prior to the needling step. This preferably is augmented by positioning the final conveyor 5 in almost tangent relationship to the roller 14.

Therefore, it is apparent that the present invention provides a unique method and apparatus for producing non-woven tubings and a new form of tubing which is subjected to radial compression immediately after its formation.

The radial compression of the tube wall not only forms a relatively thin wall, but also has a densifying effect which tends to reduce the initial permeability of the structure without permanently altering the permeability or weakening the wall structure, as may occur when such tubing is subjected to substantial longitudinal tensions.

The continuous, uniform ejection of the tubing as it is formed provides for a uniform overlapping and stitch-locking of the turns, which is of extreme importance in very thin-walled, small-diameter tubing and of great advantage in tubing of larger dimensions.

Although different shapes or flight-profiles may be employed, it has been found that the sawtooth profile disclosed provides a particularly accurate and uniform ejection of the tubing.

Tubing produced in accordance with the present invention has been particularly effective in surgical service as vascular prosthesis, not only by reason of the advantages attributable to non-woven tubing, but also as a consequence of the reliability which is achieved in small-diameter tubings of very small wall-thickness. Tubings have been produced in the range of from 4 to 30 millimeters and with wall thickness as low as 0.5mm. It is to be understood, however, that the advantages deriveable from the present invention are also appropriate to tubings of diameters larger than 30mm.

Furthermore, although the present invention has been disclosed and discussed with particular regard to its exceptional advantages in terms of vascular prosthesis, it is to be understood that the tubing of the present invention may be employed in several industrial services including tanneries, paper mills and as filtering or dewatering surfaces.

Various changes may be made in the details of the invention, as disclosed, without sacrificing the advantages thereof or departing from the scope of the appended claims.

I claim:

1. Tubing consisting of a plurality of needled coaxial overlapping turns of at least one fibrous web of non-woven fabric, a plurality of fibers integral with each turn angularly extending from said turn inwardly through at least one subjacent turn, said turns being fastened to each other by said angularly inwardly extending fiber and compressed upon each other by being radially inwardly pressed upon a helix.

* * * * *